US005785452A

United States Patent [19]

Milo et al.

[11] Patent Number: 5,785,452

[45] Date of Patent: Jul. 28, 1998

[54] MANHOLE

[75] Inventors: Joseph V. Milo, Rockaway Boro; Martin C. Pettesch, Cronford, both of N.J.

[73] Assignee: Universal Valve Co., Inc., Elizabeth, N.J.

[21] Appl. No.: 630,741

[22] Filed: Apr. 10, 1996

Related U.S. Application Data

[63] Continuation-in-part of Ser. No. 320,294, Oct. 11, 1994, abandoned.

[51] Int. Cl.[6] ..... E02D 29/14

[52] U.S. Cl. ..... 404/25; 404/26; 52/19; 52/20

[58] Field of Search ..... 404/25, 26; 52/19, 52/20; 137/363, 364, 371; 220/86.1; 138/96 R; 285/405

[56] References Cited

U.S. PATENT DOCUMENTS 4,038,789 8/1977 Axgarde et al. ..... 52/20
4,582,449 4/1986 Vosswinkel ..... 52/20 X
5,063,996 11/1991 Kenner ..... 52/20 X
5,299,884 4/1994 Westhoff et al. ..... 4504/25

FOREIGN PATENT DOCUMENTS 2204077 11/1988 United Kingdom ..... 52/19

*Primary Examiner*—James Lisehora
*Attorney, Agent, or Firm*—Edward Dreyfus, Esq.

[57] ABSTRACT

A manhole embodiment that includes a skirt made of flexible material, such as rolled sheet steel, having a stiffening flange extending laterally from the bottom rim of the skirt to increase the manhole lateral strength and provide a footing for the manhole and an outwardly extending lip at the skirt upper rim. The manhole top ring connects directly to the top of the lip. This eliminates the need for a separate piece such as the lower L-shaped ring piece included in conventional manholes. An optional extension skirt can telescope into the bottom of the upper skirt that can be held to the upper skirt by fasteners. The telescoping extension skirt can be height adjusted in the field so that the over-all height of the manhole can be adjusted to any desired height, say between 8 and 16 inches.

7 Claims, 4 Drawing Sheets

MANHOLE

RELATED PATENT APPLICATION

This is a continuation-in-part application of U.S. patent application Ser. No. 08/320,294, filed Oct. 11, 1994, now abandoned.

BACKGROUND

The present invention relates to manholes and more specifically to new manhole designs that give rise to stronger and less costly manholes compared to conventional manholes.

The art of manhole design is about one century old. Today, manholes come in a vast variety of shapes, sizes, and materials and serve a great many purposes. A manhole comprises three basic parts, namely, a closed skirt that at least partially embeds in the ground or concrete surface layer, a closed ring connected to the top of the skirt and a lid or cover that removably cooperates and permits access to the interior of the chamber defined by the skirt.

With reference to FIGS. 3 and 4, a typical conventional, circular manhole 10 is shown that comprises a cylindrical skirt 12, a closed cast metal or rolled steel top ring 14, and a removable circular metal lid 16. Skirt 12 is commonly formed from flexible sheet steel, cut and welded at a seam to form the cylinder. Flexible skirted manholes of this type were first introduced in about 1975. Top ring 14 is typically made in two circular parts, closed L-shaped lower ring 17 and cylindrical top ring 18. Ring 17 is welded to the top of skirt 12 and ring 18 is welded to the top of ring 17, generally as shown. Cover 16 rests on ring 17 when in the closed position.

In practice, manholes are fabricated at a works location and delivered with the skirt 12 and ring 14 welded in place. Installation includes usually preparing a bed of small stones 20 below ground surface, placing the manhole with the bottom rim of skirt 12 resting on stones 20 so that the top of ring 18 defines a predetermined ground plane or surface above stones 20. Concrete 22 is then poured on to stones 20 to a predetermined depth, such as a standard 8 or 16 inches.

Conventional manholes create a number of problems in the field. For example, the skirts of manholes greater than 24 inches in diameter provide insufficient lateral strength giving rise to bending or other deformation of the skirt during handling. For example, manholes are often placed or impacted on their sides during delivery from a truck or flatbed trailer, thereby resting on or impacting one point of the bottom of skirt 12. The weight of the parts or impacting lateral force thus deforms skirt 12 causing deformation of the top ring, problems with installation of the manhole itself, or the placement of equipment to be housed in the chamber.

In addition, the bottom rim of skirt 12 tends to penetrate the bed of small stones 20, thus reducing the vertical distance available for the thickness of concrete 22. This sometimes leads to the concrete depth being below required specifications which is very costly to correct.

Also, the conventional fabrication of the rings 17 and 18 on the top of skirt 12 requires many process steps and welds or connections, thus increasing the manufacturing costs of the assembly.

Another problem results during installation after the manhole is in place. The flow of concrete laterally against the skirt, if not carefully controlled, exerts lateral forces that bend the bottom of the skirt inward resulting in a distortion of the circular top ring. In this case, if the manhole cover is on during concrete pour, the ring distortion locks it on and the cover cannot be removed. If it is forced off, it will not re-seat due to the distorted ring.

Thus, there is a longfelt need in the art of making manholes with rolled steel or flexible skirts to solve the foregoing problems without increasing the cost or weight characteristics of the manhole. In addition, weight and cost benefits would result from the redesign of the double top ring manhole design to a single top ring.

SUMMARY OF EXEMPLARY EMBODIMENTS OF THE INVENTION

An exemplary manhole embodiment according to the principles of the present invention includes a skirt of flexible material having a stiffening flange extending laterally from the bottom rim of the skirt to provide lateral strength and a footing for the manhole. The flange preferably is rolled at the bottom of the sheet steel skirt so that a thinner steel sheet can be used yet with increased lateral strength for the finished manhole product.

Another aspect of the invention is to provide an outwardly extending integral lip at the skirt upper rim and connect the top ring directly to the top of the lip. This eliminates the need for a separate piece such as the lower ring 17 shown in FIG. 3 and reduces the weight, cost, and number of welds required for the finished manhole.

A still further aspect of the present invention provides a manhole having a standard depth, such as 8 inches, and an extension skirt that can telescope into the bottom of the skirt and that can be held to the skirt by fasteners. The telescoping extension skirt can be reliably height adjusted so that the over-all height of the manhole can be adjusted and fixed to any desired height, say between 8 and 16 inches.

Other and further benefits and advantages will become apparent with the following detailed description when taken in view of the appended drawings, in which:

DRAWINGS

DETAILED DESCRIPTION OF EXEMPLARY EMBODIMENTS

Figure 3:
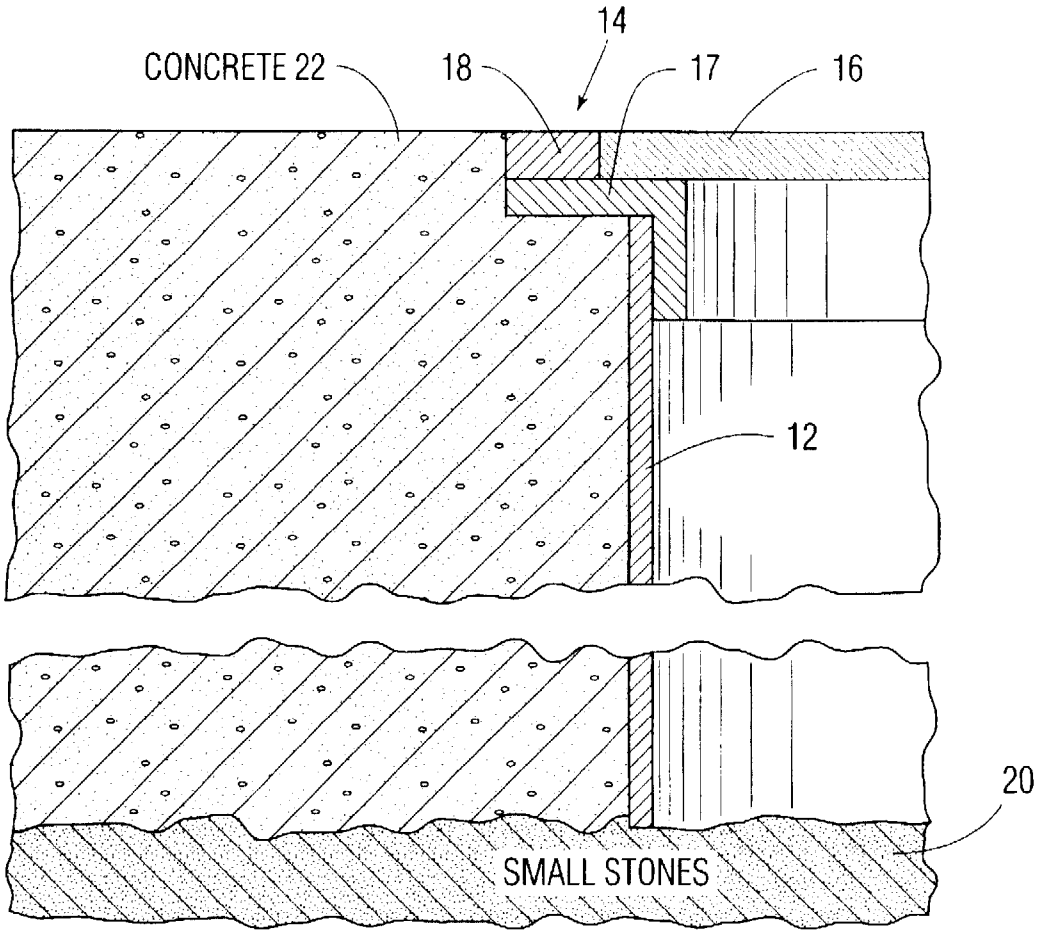
FIG. 3 PRIOR ART
FIG. 3 is a partial cross section of a PRIOR ART manhole installed on small stones and in a layer of concrete.
Figure 4:
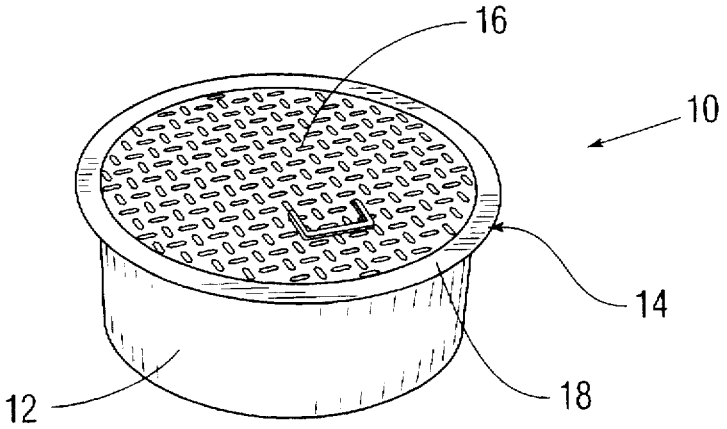
FIG. 4 PRIOR ART
FIG. 4 is a perspective view of a PRIOR ART circular manhole of the type shown in FIG. 4.

With reference to FIGS. 3 and 4, manhole 30, according to the principles of the present invention, comprises skirt 32 that terminates in its lower part in an outwardly extending flange 34. Flange 34 functions to provide stiffening strength to the skirt 34 to resist deformation from impact or bending forces that may be applied to the skirt. In the case of metal skirts, flange 35 is preferably rolled from the same work piece that forms the skirt, for example, from 12 gauge steel. In the case of molded plastic, flange can be formed when the entire skirt is molded.

The lateral dimension of flange 34 is selected to provide suitable stiffening and strength. In one example, the flange extends one-half inch from the 12 gauge, 36 inch diameter, steel skirt cylinder profile. In another example, the flange extends one-half inch from the 14 gauge, 36 inch diameter, steel skirt cylinder profile.

Figure 1:
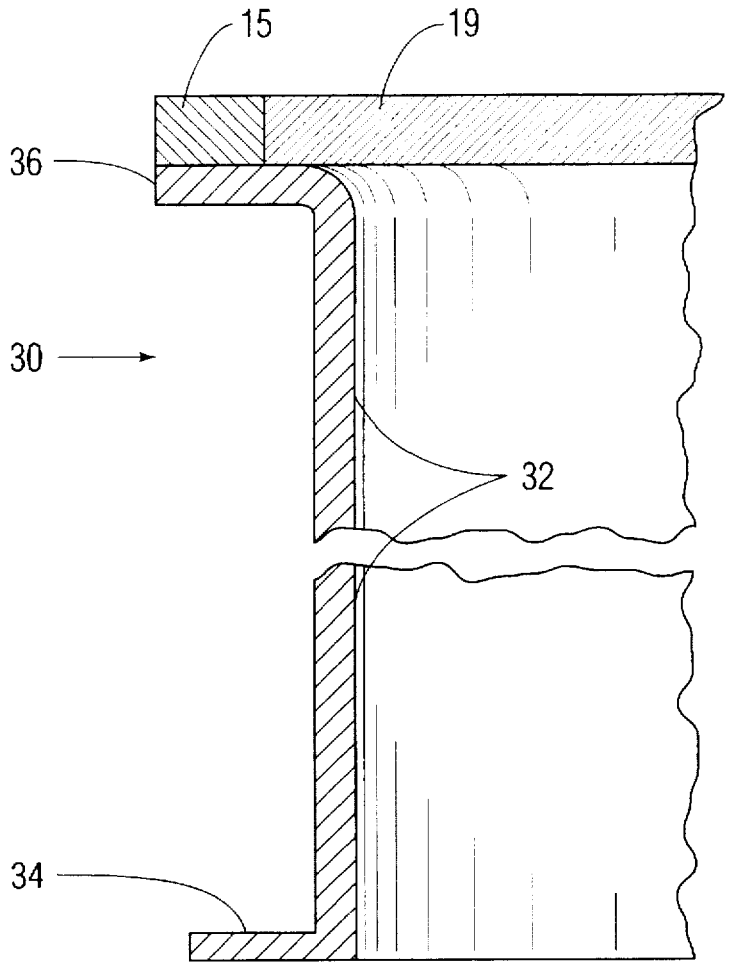
FIG. 1 is a partial cross section of one exemplary embodiment according to the principles of the present invention.

The upper rim of skirt 32 also terminates in an outwardly projecting lip 36 dimensioned to cooperate with the top ring 15, welded or bonded to the outer part of lip 36. The inner part of lip 36 is free to removably support the outer part of cover 19. It should be understood that the design combination of ring 15 and lip 36 is lighter, has less welds and fewer parts than rings 17 and 18 welded to the top of skirt 12 in FIG. 3. Nevertheless, the overall strength of the manhole of FIG. 1 is greater than that of FIG. 3 because the lateral forces are taken up by both the top combination of 15 and 36 and the bottom flange 34.

During installation, flange 34 serves as a foot piece to prevent skirt 32 from penetrating into the small stone bed or dirt, thus holding the top ring 15 a true distance above the supporting surface. Once the manhole is properly placed on the stone surface, concrete can be poured up against the outside wall of the skirt. Lateral forces from this pouring of concrete that would normally press the bottom of the skirt inward causing the skirt to deform and thereby the top ring to deform are now simply absorbed by flange 34 and the combination of flange 34 and top combination of 15 and 36.

Figure 2:
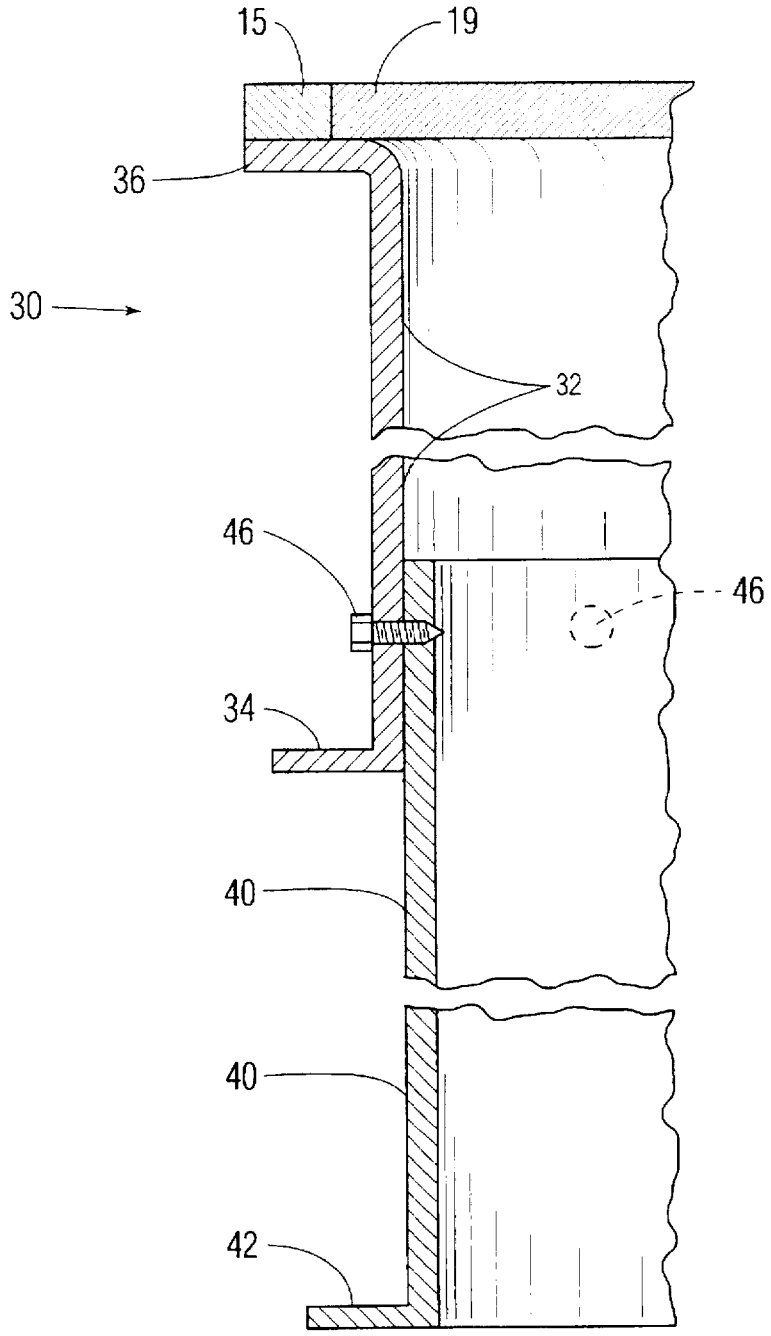
FIG. 2 is a view similar to FIG. 1 showing the extension skirt fastened to the skirt of FIG. 1.

With reference to FIG. 2, the manhole includes an extension skirt 40 having a flange 42 extending outwardly from the bottom thereof. The outer diameter of extension skirt 40 is sized to enable skirt 40 to telescope into the bottom of the chamber defined by the inner wall of skirt 32 any suitable distance within the height of skirt 40. Once in a desired telescoped position, self drilling and taping fasteners 46 or welds or other fastening means can be applied to retain the skirts 32 and 40 is the desired positions. In this way, the manhole can be designed to have any height from, for example, 8 inches to 16 inches simply by fastening skirt 40 in place. This can be done at the installation site to provide greater efficiency and effectiveness to the installation crew.

It will be understood that various changes and modifications can be made to the exemplary embodiments herein disclosed without departing from the spirit and scope of the present invention. It should also be understood that the figures hereof are not drawn to scale and although metal parts are shown in the figures, the parts can be formed of hard plastic or other suitable material if desired.

We claim:

1. A manhole comprising a top ring for containing a manhole cover, a manhole cover for being releasably contained in said top ring, a skirt made of flexible sheet steel material forming a partially closed chamber and having upper and lower portions forming major openings to said chamber, said top ring connected to said upper portion, said skirt sheet steel material and top ring being deformable when said lower portion is subjected to a lateral force greater than a predetermined lateral force, a member connected to said lower portion of said skirt for providing said skirt lateral strength and stiffness to prevent said skirt and top ring deformation resulting from said predetermined lateral force, said member comprising a laterally extending flange, said lower portion comprising a skirt bottom and said flange being positioned at the bottom of said skirt for providing a footing for said manhole, and wherein said flange is formed integrally with and of the same sheet steel material as said skirt as a single unitary piece, and wherein said flange extends outwardly from the skirt, and said skirt comprising a horizontal section, the manhole further comprising an extension skirt having a horizontal section substantially congruent to said horizontal section of said skirt and dimensioned to telescope within said skirt and into said chamber within said skirt, and wherein substantially the full outer surface of the telescoping portion of said extension skirt within said skirt is in contact with the inner surface of said skirt, and wherein joining means are provided penetrating both said skirt and said extension skirt for rigidly connecting said skirt and said extension skirt to each other at least at two points where said skirt and said extension skirt overlap and when said skirt and said extension skirt are at any of an infinite number of telescoping positions relative to each other.

2. A manhole comprising:

a top ring for containing a manhole cover, a manhole cover for being releasably contained in said top ring, a skirt made of flexible sheet steel material forming a partially closed chamber and having upper and lower portions forming major openings to said chamber, said top ring connected to said upper portion, said skirt sheet steel material and top ring being deformable when said lower portion is subjected to a lateral force greater than a predetermined lateral force, a member connected to said lower portion of said skirt for providing said skirt lateral strength and stiffness to prevent said skirt and top ring deformation resulting from said predetermined lateral force, said member comprising a laterally extending flange, said lower portion comprising a skirt bottom and said flange being positioned at the bottom of said skirt for providing a footing for said manhole, and wherein said flange is formed integrally with and of the same sheet steel material as said skirt as a single unitary piece, said skirt comprising an outwardly extending lip at its top portion, said lip having a top surface for supporting the manhole cover, said top ring being made of one of rolled steel and cast metal and having a predetermined height, and said top ring being rigidly connected to said lip and extending above said top surface, and wherein said lip is located at the top of said skirt and being formed by rolling the skirt sheet steel material to form a single unitary piece.

3. A manhole comprising a top ring for containing a manhole cover, a manhole cover for being releasably contained in said top ring, a skirt made of flexible sheet material forming a partially closed chamber and having upper and lower portions forming major openings to said chamber, said top ring connected to said upper portion, said skirt material and top ring being deformable when said lower portion is subjected to a lateral force greater than a predetermined lateral force, a member connected to said lower portion of said skirt for providing said skirt lateral strength and stiffness to prevent said skirt and top ring deformation resulting from said predetermined lateral force, said member comprising a laterally extending flange, said lower portion comprising a skirt bottom and said flange being positioned at said skirt bottom, and wherein said flange is formed integrally with and of the same material as said skirt as a single unitary piece, said flange extending outwardly from the skirt, and said skirt comprising a horizontal section, the manhole further comprising an extension skirt having a horizontal section substantially congruent to said horizontal section of said skirt and dimensioned to telescope with said skirt and into said chamber within said skirt, and wherein substantially the outer surface of the telescoping portion of said extension skirt within said skirt is in contact with the inner surface of said skirt, and said extension skirt being made of the same flexible material as said skirt and would be bendable and deformed when subjected to a predetermined lateral force and said extension skirt comprises a lower portion having a bottom and a laterally extending extension flange located at said bottom of said lower portion of said extension skirt to provide lateral strength and stiffness to said extension skirt to prevent deformation resulting from said predetermined lateral force.

4. A manhole according to claim 3 wherein extension flange extends throughout the horizontal dimension of said extension skirt.

5. A manhole according to claim 4, wherein said extension flange is formed from said extension skirt bottom as a single unitary piece with said extension skirt.

6. A manhole comprising:

a top ring for containing a manhole cover, a manhole cover for being releasably contained in said top ring, a skit made of flexible sheet material forming a partially closed chamber and having upper and lower portions forming major openings to said chamber, said top ring connected to said upper portion, said skirt material and top ring being deformable when said lower portion is subjected to a lateral force greater than a predetermined lateral force, a member connected to said lower portion of said skirt for providing said skirt lateral strength and stiffness to prevent said skirt and top ring deformation resulting from said predetermined lateral force, said member comprising a laterally extending flange, said lower portion comprising a skirt bottom and said flange being positioned at said skirt bottom, and wherein said flange is formed integrally with and of the same material as said skirt as a single unitary piece, and wherein said skirt comprises an outwardly extending lip at its top portion, said lip having a top surface, said top ring being made of rolled steel and having a predetermined height, and said top ring being rigidly connected to said lip and extending above said top surface, said lip being located at the top of said skirt and integrally formed therewith to form a single unitary piece, and wherein said skirt is made from sheet steel and said lip rolled to extend horizontally from the top of said skirt, and said manhole cover being removably supported by said top surface of said lip within said periphery of said top ring.

7. A manhole according to claim 6 wherein said flange having been rolled to extend outwardly at said bottom of said skirt.

* * * * *

UNITED STATES PATENT AND TRADEMARK OFFICE

CERTIFICATE OF CORRECTION

PATENT NO. :5,785,452

DATED :July 28, 1998

INVENTOR(S) :Joseph V. Milo, et. al.

It is certified that error appears in the above-indentified patent and that said Letters Patent is hereby corrected as shown below:

Column 5, line 33, change "skit" to --skirt--.

Signed and Sealed this

Seventeenth Day of November, 1998

Bruce Lehman

*Attest:*

BRUCE LEHMAN

*Attesting Officer*

*Commissioner of Patents and Trademarks*